US006976367B2

(12) United States Patent
Spanger

(10) Patent No.: US 6,976,367 B2
(45) Date of Patent: Dec. 20, 2005

(54) CONDENSATE OVERFLOW PREVENTION APPARATUS

(76) Inventor: Gerald S. Spanger, 402 Merrywood Dr., Edison, NJ (US) 08817

( * ) Notice: Subject to any disclaimer, the term of this patent is extended or adjusted under 35 U.S.C. 154(b) by 53 days.

(21) Appl. No.: 10/747,061

(22) Filed: Dec. 30, 2003

(65) Prior Publication Data

US 2005/0138939 A1 Jun. 30, 2005

(51) Int. Cl.[7] ..... F25D 21/14
(52) U.S. Cl. ..... 62/129; 62/188; 62/285
(58) Field of Search ..... 62/125, 126, 129, 62/188, 285, 288; 340/618, 623, 624, 625

(56) References Cited

U.S. PATENT DOCUMENTS

| | | | | |
|---|---|---|---|---|
| 4,019,570 A | | 4/1977 | Siegel | |
| 4,633,673 A | * | 1/1987 | Morrison et al. | 62/129 |
| 4,748,821 A | | 6/1988 | Berenter | |
| 4,937,559 A | | 6/1990 | Meacham et al. | |
| 5,069,042 A | | 12/1991 | Stuchlik, III | |
| 5,074,119 A | | 12/1991 | Anderson | |
| 5,271,237 A | | 12/1993 | Popelka et al. | |
| 5,323,620 A | | 6/1994 | Wood | |
| 5,341,653 A | | 8/1994 | Tippmann et al. | |
| 5,522,229 A | | 6/1996 | Stuchlik, III et al. | |
| 5,755,105 A | | 5/1998 | Lacoste | |
| 6,301,917 B1 | | 10/2001 | Lacoste | |
| 6,427,458 B1 | | 8/2002 | Fowler | |
| 6,442,955 B1 | | 9/2002 | Oakner et al. | |
| 6,442,956 B1 | | 9/2002 | Herren | |
| 6,487,867 B1 | | 12/2002 | Herren | |
| 6,592,333 B1 | | 7/2003 | Magallanes | |

OTHER PUBLICATIONS

"Condensate Overflow Protector"; Beckett Corporation.
"Drain Pan Pump".
"Wet Switch Stop the Flood"; Wagner Manufacturing.
"AquaSwitch"; EDC International Ltd.
"Low Voltage Auxiliary Condensate Switch"; Little Giant Pump Company.
Hartell Pumps.
"Model J-99, J-100 Instructions"; Milton Roy Hartell Division.
"Safety Float Switch".

* cited by examiner

*Primary Examiner*—Harry B. Tanner
(74) *Attorney, Agent, or Firm*—Oliff & Berridge, PLC

(57) ABSTRACT

A condensate overflow prevention assembly prevents condensate overflow in an air cooling system using a fluid level sensor and a pump activated by the fluid level sensor to pump the condensate away from a drainage system when a blockage occurs in the drainage system.

40 Claims, 6 Drawing Sheets

FIG. 2
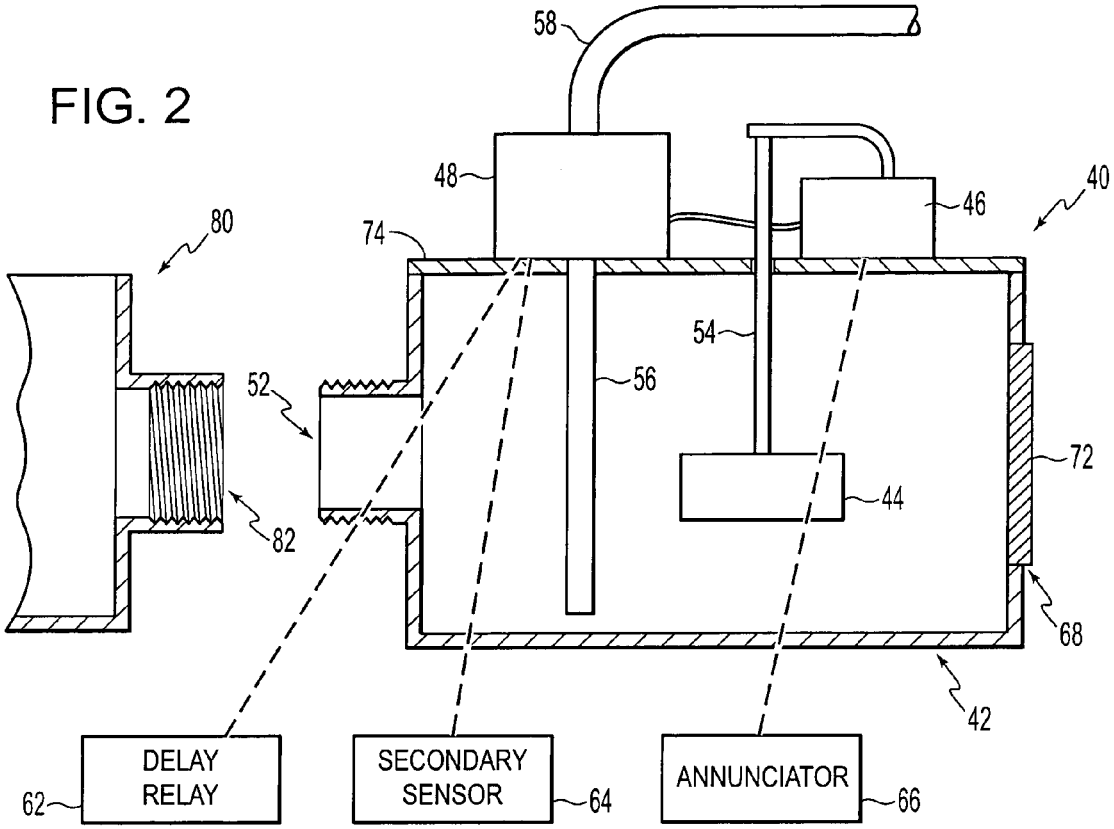
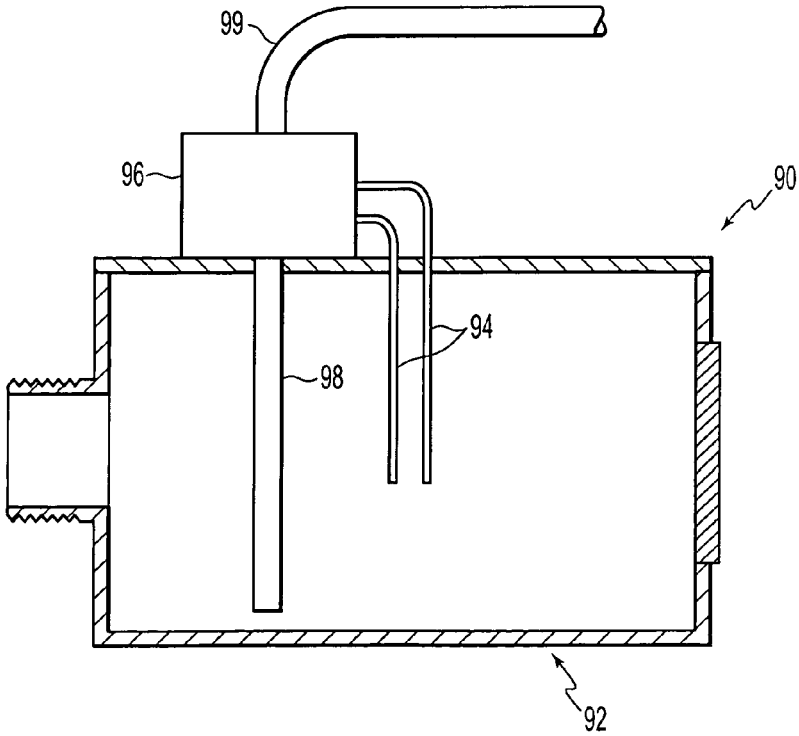
FIG. 3

CONDENSATE OVERFLOW PREVENTION APPARATUS

BACKGROUND OF THE INVENTION

1. Field of Invention

The present invention relates to a condensate overflow prevention apparatus for use with an air cooling system, and in particular to a condensate overflow prevention apparatus that uses a pump.

2. Description of Related Art

An air cooling system, such as an air conditioner or a heat pump, typically has heat exchange coils that produce condensate as the system cools the air in a building. The condensate can cause damage to structures within the building, such as dry walls, ceilings, wooden supports, etc. Thus, the condensate is collected in a drain pan usually placed below the heat exchange coils, and is transported away through a drain line connected to the drain pan. Over a period of time, a blockage can occur in the drain pan or the drain line due to debris, algae, mold, etc. The blockage causes the condensate to accumulate in the drain pan, and eventually, overflows to cause damage to the building.

U.S. Pat. No. 5,069,042 discloses a condensate trap that includes a mechanical switch and a float. When the condensate accumulates in the trap due to a blockage, the float rises with the rising level of the condensate. Eventually, the float activates the mechanical switch to shut off the air cooling system to prevent further condensate from being produced by the system.

U.S. Pat. No. 5,522,229 discloses a drain tube that includes an inlet end for attaching to a drain pan, and an outlet end for transporting condensate out of the drain pan. The drain tube includes a sensor probe that extends from the drain tube inlet end and into the drain pan when attached to the drain pan. The sensor probe detects excess condensate in the drain pan due to a blockage. When the excess condensate is detected, the sensor probe triggers a control circuit that generates an output signal to sound an alarm and/or turn off the air cooling system.

U.S. Pat. No. 5,755,105 discloses a sensor apparatus having an inlet end which attaches to the drain pan. The sensor includes a pair of water contact points at the inlet end, and when fluid or water makes contact with the points, the points become conductive, closing a circuit between the contacts. A signal is generated and is transmitted to the air cooling system to shut off the system. The sensor apparatus includes a fluid high level indicator light, which glows when this event occurs.

U.S. Pat. No. 6,442,955 B1 discloses a condensate overflow safety switch included in a T- or L-shaped tubular structure which attaches to a drain pan. The switch is electrically connected to a circuit of an air cooling system, a power circuit or an alarm circuit. The switch has an annular float containing an annular magnet mounted about a tube in which a reed switch is sealed. The float moves up and down based on the level of the liquid within the tubular structure. Depending upon a predetermined level of liquid within the tubular structure, the float will move along the tube to open or close the reed switch to either shut off the air cooling system or to activate an alarm.

U.S. Pat. No. 5,323,620 discloses an air conditioner condensate sump pump controller that controls a pump for periodically pumping condensate out of a sump. The sump pump controller includes a lower positioned positive temperature co-efficient (PTC) resistor and a higher positioned PTC resistor in the sump. When the condensate reaches the level of the lower positioned PTC resistor, the pump is activated to pump the condensate out of the sump. However, if the condensate reaches the level of the higher positioned PTC resistor, this indicates a blockage within the conduit to the pump or malfunction in the pump itself. The sump pump controller then shuts down the air conditioner to prevent further formation of the condensate.

A known drain pan pump has an encapsulated pump and electronic circuitry within a plastic housing. The drain pan pump sits on a floor of a drain pan and is activated when water is present in the drain pan. The drain pan pump is deactivated when the water has been pumped away.

SUMMARY OF THE INVENTION

Most of the above described devices switch off the air cooling system and/or activate an alarm when a condensate level in the drain pan rises due to a blockage in the drain line or the drain pan. However, shutting down the air cooling system does not prevent the air cooling system from producing further condensate due to residual cold coolant remaining in the heat exchange coils. The condensate can continue to drip into the drain pan, and eventually, the rising condensate can overflow from the drain pan causing water damage even though the air cooling system has ceased operating and an alarm, if fitted, has been activated. Thus, it is highly desirable to evacuate any excess condensate as soon as possible before it can overflow, and cause property damage.

Accordingly, a condensate overflow prevention device according to aspects of the invention is attachable to a drainage system, and includes a fluid pump that pumps out any excess condensate in the drainage system before the condensate overflows and causes damage. A fluid level sensor senses a level of condensate, and if the condensate level exceeds a predetermined level, the fluid level sensor activates the fluid pump to pump out the excess condensate from the drainage system.

These and other features and advantages of the invention are described in, or are apparent from, the following description of various exemplary embodiments of the invention.

BRIEF DESCRIPTION OF THE DRAWINGS

Various exemplary embodiments of the invention are described in detail with reference to the following figures wherein:

FIG. 2 illustrates an exemplary embodiment of a condensate overflow prevention device that includes a fluid pump activated by a switch and float mechanism;

FIG. 3 illustrates an exemplary embodiment of a condensate overflow prevention device that includes a fluid pump activated by probes or electrodes;

DETAILED DESCRIPTION OF EXEMPLARY EMBODIMENTS

Figure 1:
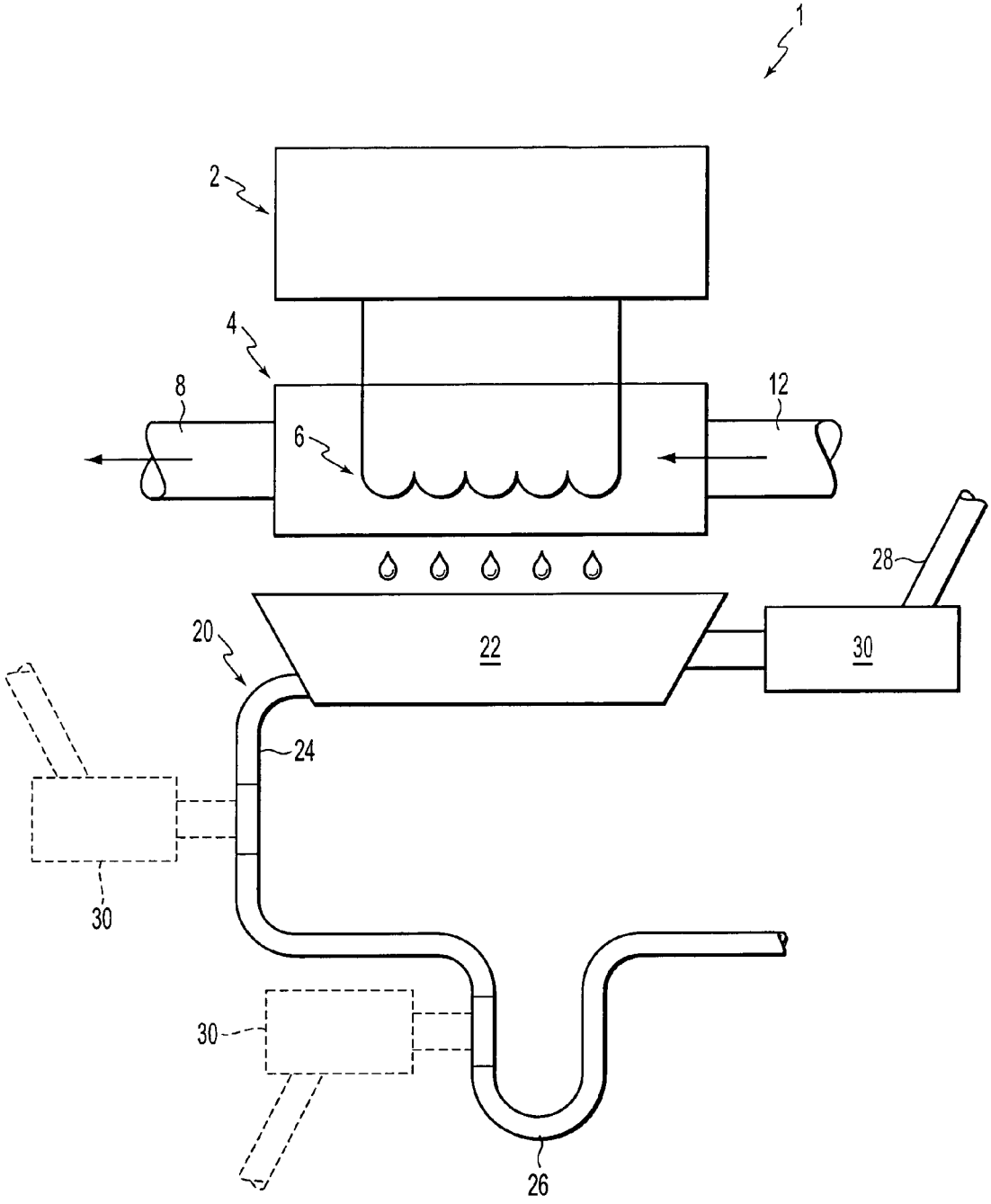
FIG. 1 is a diametric view of an air cooling system incorporating a condensate overflow prevention device of embodiments of the present invention.

FIG. 1 illustrates an air cooling system 1 including a drainage system 20 that includes a condensate overflow prevention device 30 according to an exemplary embodiment of the present invention. The air cooling system 1 includes an air conditioner 2 coupled to an air handler 4. The air conditioner 2 circulates and cools a coolant passing through the air conditioner 2. The air handler 4 contains heat exchange coils 6 through which the cold coolant circulates. Warm air is conveyed to the air handler 4 through an inlet duct 12. The warm air is cooled as it makes contact with the exchange coils 6. The cool air is then transported away from air handler 4 through an outlet duct 8. When the warm air is cooled, moisture in the air condenses on the heat exchange coils 6 as liquid droplets or condensate.

The drainage system 20 includes a drain pan 22, a drain line 24 and at least one condensate overflow prevention device 30. The drainage system 20 also may include a condensate trap 26. The condensate produced by the heat exchange coils 6 drips into the drain pan 22, which is placed below the heat exchange coils 6. The drain pan 22 is coupled to a drain line 24 which transports the condensate to a drain.

In one embodiment, the condensate overflow prevention device 30 is attached to an outlet of the drain pan 22. The condensate overflow prevention device 30 detects for an excess level of condensate in the drain pan 22. Usually, the condensate that drips into the drain pan 22 flows away into the drain line 24 connected to the drain pan 22. However, if a blockage occurs in the drain line 24, or in the drain pan 22 adjacent to the inlet of the drain line 24, for example, due to accumulation of debris, algae, mold, etc., the condensate starts to accumulate and fill the drain pan 22. When the condensate exceeds a predetermined level in the drain pan 22, the condensate overflow prevention device 30 is activated and pumps the condensate out of the drain pan 22 and into another drain line 28, for example. In this manner, the condensate is prevented from overflowing out of the drain pan 22.

The condensate overflow prevention device 30 need not necessarily be attached to the drain pan 22. For example, the condensate overflow prevention device 30 can be attached to the drain line 24 or to the condensate trap 26, as shown in FIG. 1. Simply stated, the condensate overflow prevention device 30 may be installed in any location in the drainage system 20 where a blockage may occur, which can be promptly detected, thereby preventing condensate overflow and associated damage. The condensate overflow prevention device 30 may be externally attachable, for example, to the drain pan 22, to the drain line 24 or to the condensate trap 26. Moreover, multiple condensate overflow prevention devices 30 may be attached throughout the drainage system 20 to prevent condensate overflow.

It is preferable to attach the condensate overflow prevention device 30 to the drain pan 22 because it will be effective in dealing with blockages that occur anywhere in the drainage system (i.e., the device 30 may not detect a blockage at the inlet to the drain line 24 if the device 30 is located downstream of the blockage, e.g., in the trap 26). Since most drain pans 22 have a primary outlet and a secondary outlet, the overflow prevention device 30 can be attached to the secondary outlet when the drain line 24 is attached to the primary outlet.

FIG. 2 illustrates a condensate overflow prevention device 40 according to an exemplary embodiment of the invention. The condensate overflow prevention device 40 includes a hollow body 42, a fluid level sensor, such as a float 44, a switch 46 and a pump 48. The hollow body 42 may be a circular or a multi-sided tubular structure made of plastic, such as polyvinyl chloride (PVC), thermoplastic, etc.; metal, such as brass, aluminum, steel, etc.; or ceramic, etc. In various embodiments, the hollow body 42 is transparent to allow an owner to see (inspect) the interior of the hollow body 42.

The hollow body 42 includes an inlet 52 which protrudes from the hollow body 42 and is attachable to a part of the condensate drain system such as a drain pan, a drain line, a condensate trap, etc. For illustration purposes, the system is coupled to a drain pan 80. The inlet 52 is threaded to mate with an outlet 82 of the drain pan 80, which also is threaded. In other embodiments, the inlet 52 of the hollow body 42 and the outlet 82 of the drain pan 80 are not threaded. For example, the inlet 52 can be adapted to snap fit with the outlet 82 of the drain pan 80. In another example, the surface of the inlet 52 may be smooth or roughened, glued and slip fitted to the outlet 82 of the drain pan 80. Various methods of attaching the inlet 52 to the outlet 82 of the drain pan 80 can be contemplated by those skilled in the art.

The float 44 is disposed within the hollow body 42 and is connected to a switch 46, which is external to the hollow body 42, via a shaft 54. However, the switch 46 need not necessarily be external to the hollow body 42 and in other embodiments, the switch 46 is disposed within the hollow body 42. The float 44 can ascend and descend (i.e., move up and down) within the hollow body 42 such that as the condensate flows from the drain pan 80 and into the hollow body 42 through the inlet 52, the float 44 elevates with the level of condensate in the hollow body 42. As the float 44 elevates, the float 44 urges the shaft 54 towards the switch 46, and when the float 44 elevates to a predetermined level, the shaft 54 has moved sufficiently to activate the switch 46. The float 44 may be suspended initially at a fixed position, thereby the predetermined level in which the float 44 activates the switch 46 may be fixed or the initial position of the float 44 may be adjustable such that the installer can set the desired condensate level which would activate the switch 46.

The switch 46 is electrically coupled to the pump 48 which, in turn, is in fluid communication with the interior of the hollow body 42 via a tube 56. The tube 56 may be made of plastic, metal, etc. When the switch 46 is activated, the switch 46 activates the pump 48 to pump the condensate out of the hollow body 42 and into a drain line 58 in fluid communication with the pump 48. The pump 48 will continue to pump the fluid out of the hollow body 42 until the float 44 descends to a lower level that deactivates the switch 46 or the pump 48 is shut off. For example, the pump 48 may be fitted with a time delay relay 62 or a secondary sensor 64 or a combination of both to ensure that the pump 48 does not continue to operate after the condensate level has receded.

An annunciator 66, such as a warning light and/or an audio alarm, etc., may be connected to the switch 46 by electrical wires or the annunciator 66 may be wirelessly thereto. When the switch 46 is activated by the float 44, the switch 46 activates the annunciator 66 to alert the owner that excess condensate has accumulated in the drain pan 80.

The hollow body 42 may further include an outlet 68 which is covered by a cap 72. When the cap 72 is removed, additional drain line or a pump may be connected to the hollow body to expedite the transport of the condensate away from the hollow body 42. Alternatively, the outlet 68 may be used to access the interior of the hollow body 42 and if necessary, a brush may be used to clean the interior of the hollow body 42. In various embodiments, the hollow body 42 may further include a removable top plate 74 holding the switch 46 and the pump 48.

FIG. 3 illustrates a condensation overflow prevention device 90 according to another exemplary embodiment of the invention. The condensate overflow prevention device 90 of FIG. 3 may be similar in configuration and operation to that illustrated in FIG. 2. However, instead of using a fluid level sensor that relies on a float and a switch, the condensate overflow prevention device 90 of FIG. 3 uses a fluid level sensor having sensing probes or electrodes 94 to sense excess condensate in the hollow body 92.

As shown in FIG. 3, two probes or electrodes 94 are disposed at a predetermined level within the hollow body 92. The probes or electrodes 94 may be made of metal such as copper, aluminum, etc. The predetermined level of the probes or electrodes 94 may be fixed or may be adjustable such that the installer can set the required condensate level which would cause an electrical connection between the probes or electrodes 94. The probes or electrodes 94 may directly activate the pump 96, or the probes or electrodes 94 may be connected to a pump control circuit (not shown) which activates the pump 94. When the condensate flows from the drain pan and into the hollow body 92 due to a blockage, the level of the condensate rises within the hollow body 92. When the condensate contacts the probes or electrodes 94, the probes or electrodes 94 conduct electricity. This activates the pump 96 to pump the condensate out of the hollow body 92 via a tube 98 and into a drain line 99 in fluid communication with the pump 96.

Figure 4:
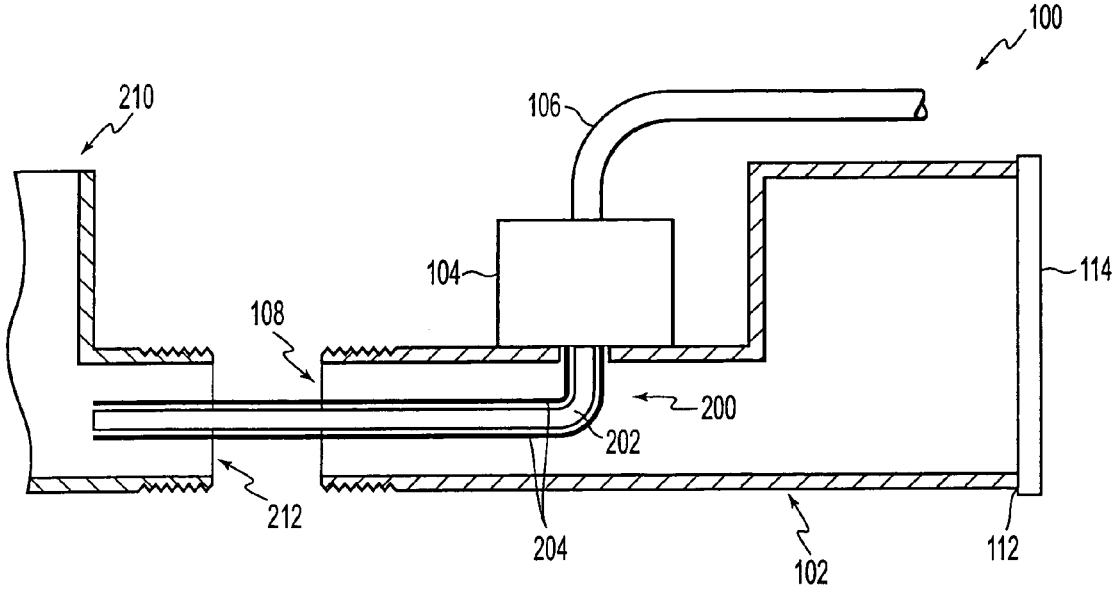
FIG. 4 illustrates an exemplary embodiment of a condensate overflow prevention device that includes a fluid pump activated by an integrated tube/probe.

FIG. 4 illustrates a condensate overflow prevention device 100 according to another exemplary embodiment of the invention. The condensate overflow prevention device 100 includes an elbow-shaped body 102, a pump 104 and an integrated probe/tube 200. The elbow-shaped body 102 may be circular or multi-sided, may be hollow, and made of plastic, metal or ceramic, for example. The pump 104 is located on an outer surface of the elbow-shaped body 102, however, the pump 104 need not necessarily be located exterior to the elbow-shaped body 102, and in other embodiments, the pump 104 is disposed in the interior of the elbow-shaped body 102. The pump 104 is coupled to one end of the integrated probe/tube 200 and is in fluid and electrical communication with the integrated probe/tube 200. The other end of the integrated probe/tube 200 extends out from an inlet 108 of the elbow-shaped body 200 and into the drain pan 210 via an outlet 212 of the drain pan 210. The tube 202 is in fluid communication between the drain pan 210 and the pump 104. Two probes or electrodes 204, which may be electrical wires run longitudinally from one end to the other end of the tube 202. One end of the probes or electrodes 202 are electrically connected to the pump 104 and the other end of the probes or electrodes 202 are exposed at the end of the integrated probe/tube 200.

When the condensate level in the drain pan 210 rises due to a blockage, and makes contact with the probes or electrodes 204, the probes or electrodes 204 conduct electricity, and activate the pump 104. The pump 104 operates to pump the condensate out of the drain pan 210 through the tube 202 and into a drain line 106 in fluid communication with the pump 104. By extending the integrated probe/tube 200 into the drain pan 210, excess condensate in the drain pan 210 can be drained out even though the drain pan outlet 212 to which the condensate overflow prevention device 100 is attached is blocked with debris, algae, etc. Additionally, an advantage of sensing the condensate level inside the drain pan 210 is provided rather than sensing the condensate outside of the drain pan 210. The condensate overflow prevention device 100 may further include an outlet 112 which is covered by a cap 114.

Figure 5:
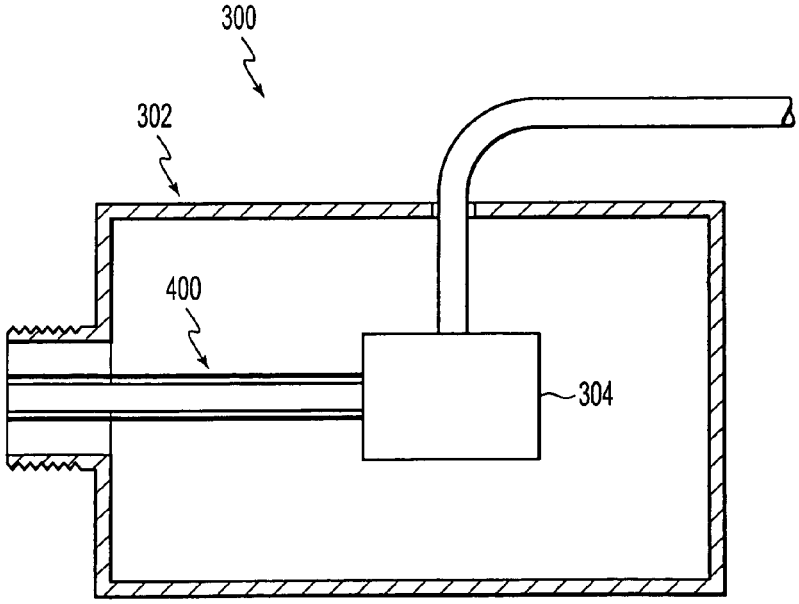
FIG. 5 illustrates an exemplary embodiment of a condensate overflow prevention device where the body of the condensate overflow prevention device is molded onto a fluid pump and an integrated tube/probe.

FIG. 5 illustrates a condensate overflow prevention device 300 in accordance with another exemplary embodiment of the invention. The condensate overflow prevention device 300 includes a body 302, a pump 304 and an integrated probe/tube 400. The body 302 is solid and may be mold injected onto the pump using plastics such as PVC, thermoplastics or non-thermoplastics, or hard rubber. The pump disposed within the body is coupled to one end of the integrated probe/tube 400, and the other end of the probe/tube 400 is exposed at an inlet of the body 302. The operation of the condensate overflow device 300 is similar to that of the exemplary condensate overflow device 100 illustrated in FIG. 4.

Figure 6:
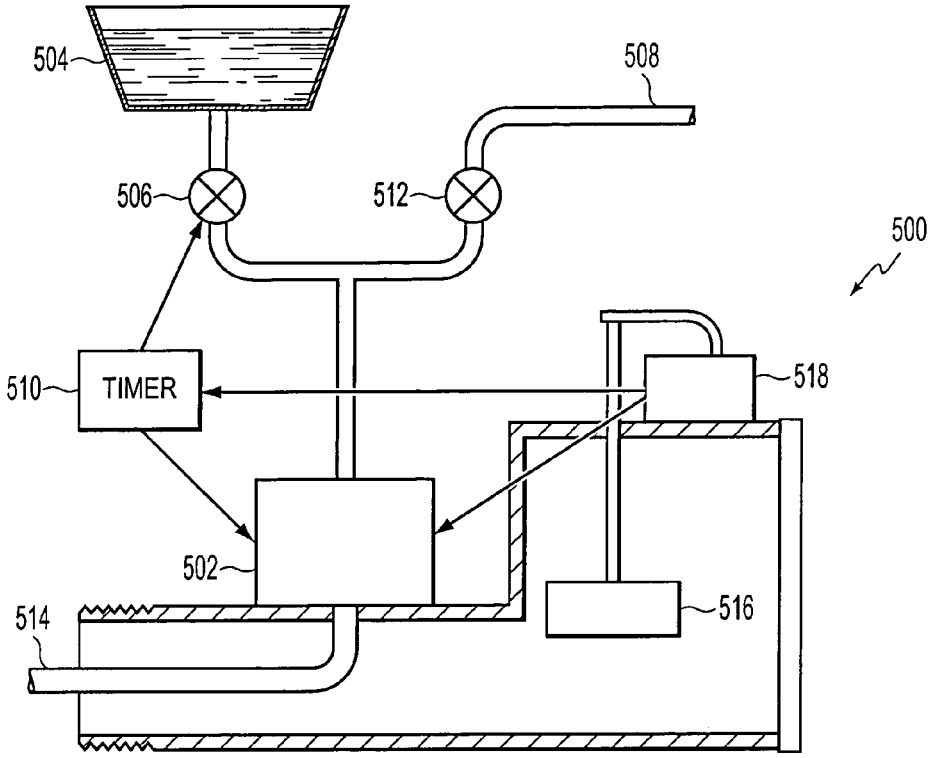
FIG. 6 illustrates an exemplary embodiment of a condensate overflow prevention device that includes a reversible fluid pump to pump drain pan cleaning chemicals from a reservoir into a drain pan in a first operating mode and to pump fluid away from the drain pan in a second operating mode.
Figure 7:
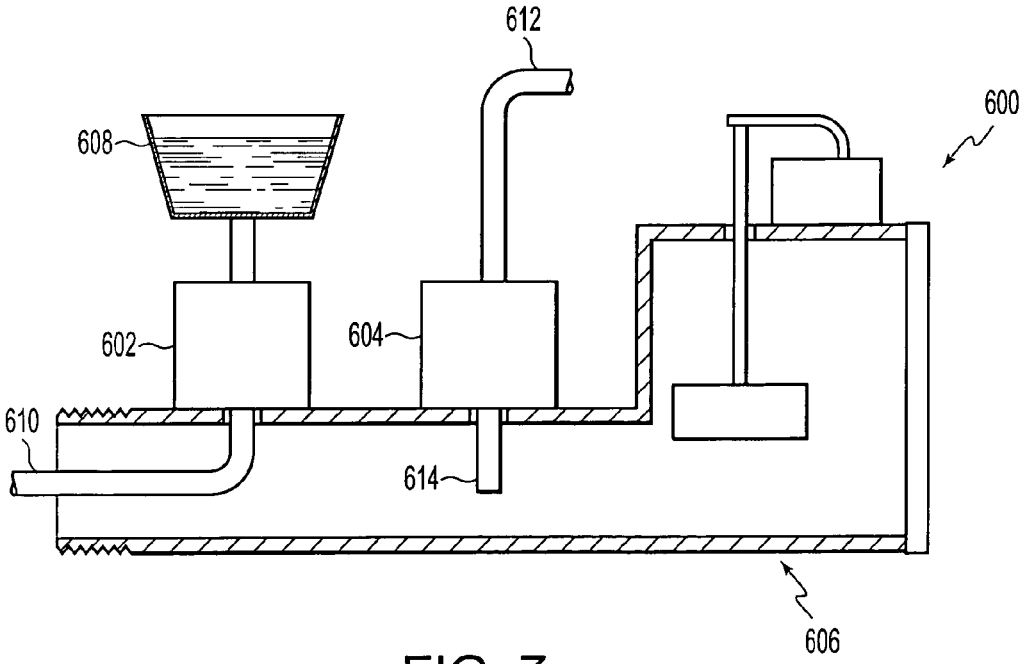
FIG. 7 illustrates an exemplary embodiment of a condensate overflow prevention device that includes a first pump to pump drain pan cleaning chemicals from a reservoir into a drain pan, and a second pump to pump fluid away from the drain pan.

FIG. 6 illustrates a condensate overflow prevention device 500 in accordance with another exemplary embodiment of the invention. The condensate overflow prevention device 500 of FIG. 6 may be similar in configuration and operation to that of the exemplary condensate overflow prevention device 40 of FIG. 2. However, the condensate overflow prevention device 500 of FIG. 6 uses a reversible type pump 502, which is coupled to a reservoir 504 of drain pan cleaning chemicals via a valve 506, and is further coupled to a drain line 508 via another valve 512. The reversible type pump 502 is controlled by a suitable mechanical, electrical or electronic timer 510 that could be adjusted as desired. The timer 510 enables the pump 502 to pump a metered dosage of drain pan cleaning chemicals in the drain pan periodically. The timer 510 also enables the valve 506 to open thereby forming a passage from the reservoir 504 to the pump 502. The pump 502 then pumps the drain pan cleaning chemicals into the drain pan via a tube 514. In the event of a blockage, a fluid level sensor 516 detects excess condensate in the body 502 of the condensate overflow prevention device 500 and activates a switch 518. The switch 518 disables the timer 510 and causes the pump 502 to reverse direction and pump out any excess condensate in the drain pan. As illustrated in FIG. 7, in another exemplary embodiment of a condensate overflow prevention device 600 according to the invention, two pumps 602 and 604 are mounted on a hollow body 606 of the condensate overflow prevention device 600. The pump 602 is coupled to a reservoir 608 of drain pan cleaning chemicals and is further coupled to a tube 610 in fluid communication with the drain pan. The pump 604 is coupled to a drain line 610 and is further coupled to a tube 614 in fluid communication with the hollow body 606. The pump 602 periodically pumps metered doses of chemicals into the drain pan. When a blockage is detected, the pump 604 operates to pump excess condensate from the hollow body 606, but in this embodiment, the pump 602 continues to pump meter doses of chemicals into the drain pan.

Figure 8:
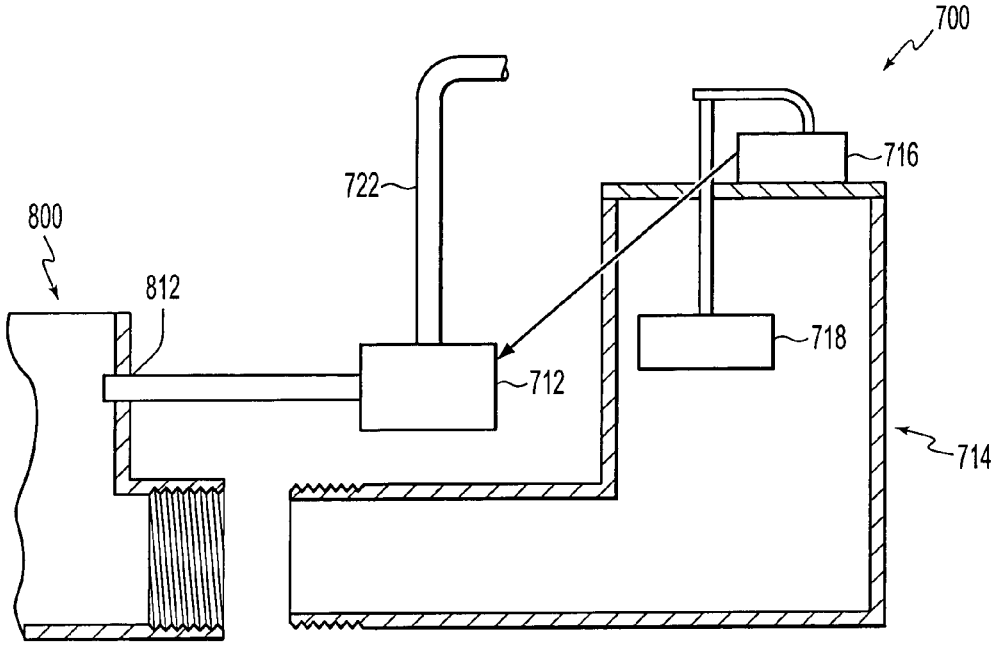
FIG. 8 illustrates an exemplary embodiment of a condensate overflow prevention device where the pump is separate from the condensate overflow prevention device and is coupled to an outlet of a drain pan.
Figure 9:
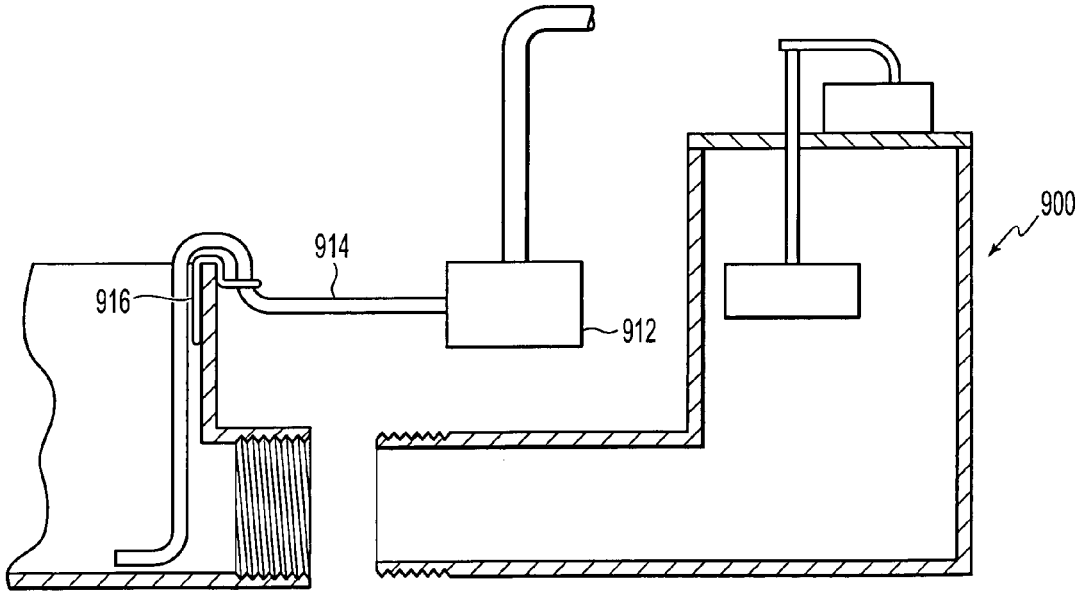
FIG. 9 illustrates an exemplary embodiment of a condensate overflow prevention device where the pump is separate from the condensate overflow prevention device and the tube coupling the pump to the drain pan is placed over a side and into the drain pan.

FIG. 8 illustrates another exemplary embodiment of a condensate overflow prevention device 700 according to the invention. The condensate overflow prevention device 700 of FIG. 8 may be similar in configuration and operation to that of the exemplary condensate overflow prevention device 40 of FIG. 2. However, in the condensate overflow prevention device 700 of FIG. 8, the pump 712 is separate from the body 714 of the condensate overflow prevention device 700, but the pump 712 is in electrical communication with the switch 716. The pump 712 is coupled to an outlet 812 of a drain pan 800 via a tube 718. When a blockage is detected by a fluid level sensor 718, the fluid level sensor 718 causes the switch 716 to activate the pump 712. The pump 712 pumps the condensate from the drain pan 800 to a drain line 722. FIG. 9 illustrates another exemplary embodiment of a condensate overflow prevention device 900 according to the invention. In the condensate overflow prevention device 900 of FIG. 9, the pump 912 is connected to a tube 914 which goes over a side of a drain pan 1000. The tube 914 is attached to the side of the drain pan 1000 with a clip 916.

Various embodiments of the condensate overflow prevention device have been described above. In various embodiments, the condensate overflow prevention device can be mounted in a primary drain pan, as an integral part of the drain pan or as a retrofitted component after installation. In various embodiments, the condensate overflow prevention device can be fitted in the primary or secondary drain outlet of the primary drain pan inside an air cooling system or to a condensate trap, which is normally attached to the primary drain outlet of the drain pan, either in proximity to or remote from the air cooling system.

Figure 10:
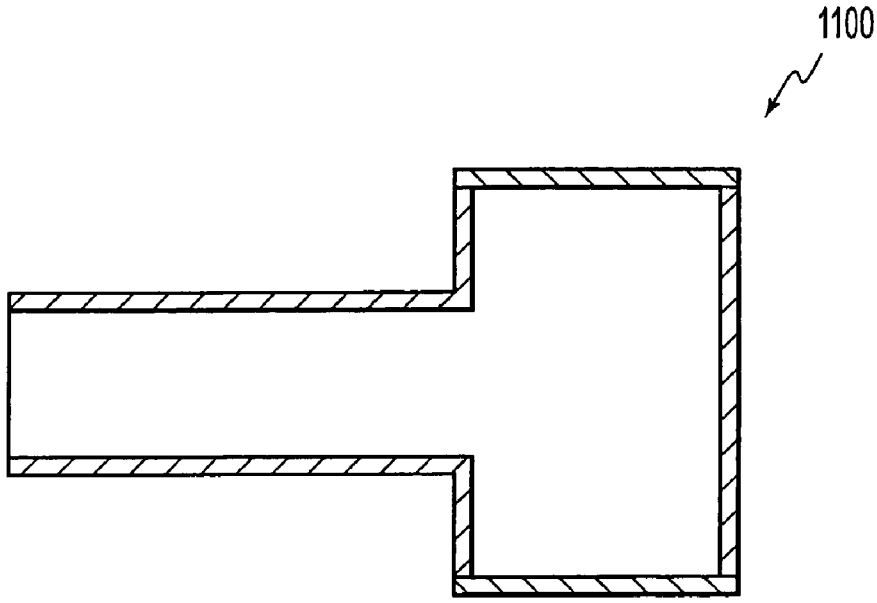
FIG. 10 illustrates a tee-structure of an exemplary embodiment of a condensate overflow prevention device.
Figure 11:
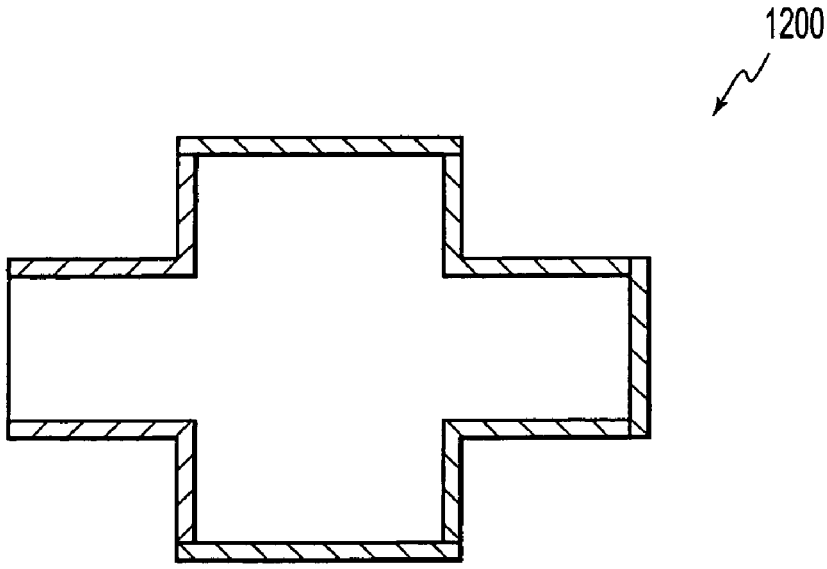
FIG. 11 illustrates a cross-structure of an exemplary embodiment of a condensate overflow prevention device.

It should be appreciated that the body of the condensate overflow prevention device is not limited to a tubular structure or an elbow-shaped structure. For example, as shown in FIG. 10, the hollow body 1100 may be a tee-shaped structure, or as shown in FIG. 11, the hollow body 1200 may be a cross-shaped structure. Furthermore, caps may be used to cover any of the openings of the hollow body as necessary.

In various embodiments, the switch can be mechanical, and can be a single or multiple electronic probe or sensor, reed type, ultrasonic, optical, light fiber, pneumatic or can use any other known switching method, or any combination of the above, all of which can be capable of single or multiple pole switching for the purpose of carrying out simultaneous multi-switching operations without the necessity of any extra relays.

In various embodiments, the pump can be directly mounted on a body of the condensate overflow prevention device so that the pump actually drains directly from the body itself, or the pump can be connected via a flexible tube to an outlet on the body. The pump may be positioned on any part of the surface of the body of the condensate overflow prevention device, which provides for a desirable drain of the body. The pump also can be connected via a flexible tube to a specially placed inlet inside a drain pan which can be integrated into the drain pan structure, or the pump can be retrofitted to the drain pan after installation of the air cooling system. The pump can be externally mounted onto the condensate overflow prevention device or the pump can be clamped to a drain line or the pump can be attached to a primary or secondary drain pan as an integral part or as a retrofit.

The pump may operate on a battery, a 6 volt, a 12 volt, a 24 volt, a 120 volt, a 220 volt, or any other voltage AC or DC, which may prove to be practical, for example, for the purpose of connecting into an electrical building monitoring system or meeting current or future building codes.

In various embodiments, the condensate overflow prevention device includes an optional integral warning lamp and/or audible alarm to alert service personnel or owners on a local level that the high condensate level has occurred.

In various embodiments, the annunciator can also communicate directly with the air cooling system and/or an external alarm by means of wiring, wireless RF frequency, infrared, ultraviolet, ultrasonic or any of the known communication technology or any combination of the above.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single light emitting element, are also within the spirit and scope of the invention.

What is claimed is:

1. A condensate overflow prevention apparatus comprising:

a hollow body having an inlet that is attachable to a condensate drainage system;

a fluid level sensor coupled to the hollow body, at least a portion of the sensor located within the hollow body, the sensor sensing a fluid level within the hollow body; and a pump coupled to the hollow body, the pump is activated by the sensor to pump the fluid from the hollow body and the drainage system when the sensor senses a predetermined level of the fluid in the hollow body that is indicative of a blockage in a drainage flow path of the drainage system.

2. The apparatus of claim 1, further comprising:

a tube having a first end coupled to the pump and a second end located within the hollow body.

3. The apparatus of claim 1, further comprising:

a tube having a first end coupled to the pump, at least a portion of the tube located within the hollow body, and having a second end that extends out through the inlet of the hollow body for location within the drainage system.

4. The apparatus of claim 1, further comprising:

a tube having a first end coupled to the pump, the tube is located external of the hollow body.

5. The apparatus of claim 4, further comprising:

a clip that clips the tube to a side of a drain pan of the drainage system such that a portion of the tube that includes a second end of the tube can be placed inside the drain pan.

6. The apparatus of claim 4, wherein the tube has a second end attachable to a condensator drain pan outlet of the drain pan.

7. The apparatus of claim 1, wherein the pump is attached to a surface of the hollow body and pumps fluid directly from within the hollow body.

8. The apparatus of claim 1, wherein the senor includes a float coupled to a switch that activates the pump when the float, which is located within the hollow body, reaches a predetermined level in the hollow body.

9. The apparatus of claim 1, wherein the sensor includes a probe having at least two contacts, the probe conducts electrically when the fluid makes contact with the at least two contacts.

10. The apparatus of claim 1, further comprises a timer coupled to the pump, and that sets a time interval during which the pump operates.

11. The apparatus of claim 1, further comprises an annunciator coupled to the sensor and that is activated by the sensor when the predetermined level of the fluid is sensed by the sensor.

12. The apparatus of claim 11, wherein the annunciator is wirelessly coupled to the sensor.

13. The apparatus of claim 1, further comprising:

a second pump, coupled to the hollow body, to pump at least one chemical into the drainage system to remove or prevent the blockage in the drainage system.

14. The apparatus of claim 1, wherein the hollow body further comprises an outlet.

15. The apparatus of claim 14, further comprising:

a cap that removably covers the outlet.

16. The apparatus of claim 1, wherein the inlet of the hollow body is threaded.

17. The apparatus of claim 1, wherein the hollow body is transparent.

18. The apparatus of claim 1, wherein the apparatus is externally attachable to a drain pan of the condensate drainage system.

19. An air-handling system comprising:

an air cooling system that generates condensate;

a condensate drainage system that collects the condensate produced by the air cooling system and drains the condensate through a first drain line; and the condensate overflow prevention apparatus of claim 1, coupled to the condensate drainage system, wherein the pump pumps the condensate from the condensate drainage system to a second drain line when the sensor activates the pump.

20. The system of claim 19, wherein the inlet of the hollow body is attached to an outlet of a drain pan included in the condensate drainage system.

21. The system of claim 19, wherein the inlet of the hollow body is attached to the first drain line of the condensate drainage system.

22. The system of claim 19, wherein the inlet of the hollow body is attached upstream of a fluid-trap provided in the condensate drainage system.

23. A condensate overflow prevention apparatus comprising:

a hollow body having a first open end that is attachable to a condensate drainage system;

a tube having a first end that extends out through the first open end of the hollow body;

a sensor having a sensing portion located at the first end of the tube; and a pump coupled to the hollow body and that is activated by the sensor to pump fluid away from the condensate drainage system when the sensor senses a predetermined level of the fluid that is indicative of a blockage in a drainage flow path of the condensate drainage system, the pump is in fluid communication with the tube.

24. The apparatus of claim 23, wherein the pump is located within the hollow body and is connected to a second end of the tube.

25. The apparatus of claim 23, wherein the pump is located external of the hollow body and is connected to a second end of the tube that protrudes from a second open end of the hollow body.

26. The apparatus of claim 23, wherein the sensor includes at least two contacts, and conducts electricity when the fluid makes contact with the at least two contacts.

27. The apparatus of claim 23, further comprising a timer coupled to the pump and that sets a time interval during which the pump operates.

28. The apparatus of claim 23, further comprising an annunciator coupled to the sensor and that is activated by the sensor when the fluid is sensed by the sensor.

29. The apparatus of claim 28, wherein the annunciator is wirelessly coupled to the sensor.

30. The apparatus of claim 23, further comprising:

a second pump coupled to the hollow body to pump at least one chemical into the condensate drainage system to remove or prevent the blockage in the condensate drainage system.

31. The apparatus of claim 23, wherein the apparatus is externally attachable to the condensate drainage system.

32. A system comprising:

an air conditioner/heat pump;

a condensate conduit attached to a first drain line, the condensate conduit channeling condensate produced by the air conditioner/heat pump to the first drain line; and the condensate overflow prevention apparatus of claim 19, coupled to the condensate conduit, wherein the pump pumps the condensate from the condensate conduit to a second drain line when the sensor activates the pump.

33. A condensate overflow prevention apparatus comprising:

a hollow body having an inlet that is attachable to a condensate drainage system;

a fluid level sensor coupled to the hollow body, at least a portion of the sensor located within the hollow body, the sensor sensing a fluid level within the hollow body; and a reversible type pump coupled to the hollow body, wherein in a first mode, the pump is activated by the sensor to pump the fluid from the hollow body and the drainage system when the sensor senses a predetermined level of the fluid in the hollow body, and in a second mode, the pump is activated to pump a cleaning chemical into the drainage system through the hollow body.

34. The apparatus of claim 33, further comprising:

a timer that activates the pump to pump the cleaning chemical into the drainage system.

35. The apparatus of claim 33, wherein the apparatus is externally attachable to a drain pan of the condensate drainage system.

36. A condensate overflow prevention apparatus comprising:

a hollow body having an inlet that is attachable to a condensate drainage system;

a tube having a first end that extends out through the inlet of the hollow body;

a sensor having a sensing portion located at the first end of the tube; and a reversible pump coupled to the hollow body, wherein in a first mode, the pump is activated by the sensor to pump fluid away from the condensate drainage system when the sensor senses the fluid, the pump is in fluid communication with the tube, and in a second mode, the pump is activated to pump a cleaning chemical into the condensate drainage system.

37. The apparatus of claim 36, further comprising:

a timer that activates the pump to pump the cleaning chemical to the drainage system.

38. The apparatus of claim 36, wherein the apparatus is externally attachable to a drain pan of the condensate drainage system.

39. A condensate overflow prevention apparatus comprising:

sensing means for sensing that a blockage has occurred in a condensate drainage system, the blockage causing a level of fluid in the condensate drainage system to rise; and pumping means for pumping fluid from the condensate drainage system via an overflow fluid path if the sensing means senses the blockage.

40. The apparatus of claim 39, further comprising alarm means for annunciating that the blockage has occurred.

* * * * *